US011380510B2

(12) United States Patent
Iida et al.

(10) Patent No.: US 11,380,510 B2
(45) Date of Patent: Jul. 5, 2022

(54) X-RAY TUBE AND A CONTROLLER THEREOF

(71) Applicant: Nanox Imaging PLC

(72) Inventors: Koichi Iida, Hokkaido (JP); Jun Yamasaki, Ichinomiya (JP)

(73) Assignee: NANO-X IMAGING LTD., Neve-Ilan (IL)

( * ) Notice: Subject to any disclaimer, the term of this patent is extended or adjusted under 35 U.S.C. 154(b) by 604 days.

(21) Appl. No.: 15/596,303

(22) Filed: May 16, 2017

(65) Prior Publication Data

US 2018/0005796 A1 Jan. 4, 2018

Related U.S. Application Data

(60) Provisional application No. 62/336,832, filed on May 16, 2016.

(51) Int. Cl.
*H05G 1/52* (2006.01)
*H01J 35/14* (2006.01)
(Continued)

(52) U.S. Cl.
CPC ..... *H01J 35/153* (2019.05); *H01J 35/04* (2013.01); *H01J 35/30* (2013.01); *H05G 1/32* (2013.01);
(Continued)

(58) Field of Classification Search
CPC .. A61K 2039/55505; A61K 2039/6087; A61K 2039/70; A61K 39/104; A61K 39/385; A61K 39/39; A61K 47/61; H01J 2235/062; H01J 35/04; H01J 35/14; H01J 35/30; H01J 2201/32; H01J 29/023; H01J 29/06; H01J 29/085; H01J 29/467; H01J 31/123; H01J 31/127; H01J 3/022; H01J 1/3048; H01J 2235/068; H01J 1/30; H01J 2201/319; H01J 2203/0204; H01J 35/065; H01J 3/021; H01J 3/027; H01J 1/3042; H01J 2235/02; H01J 2201/30449;
(Continued)

(56) References Cited

U.S. PATENT DOCUMENTS 3,250,916 A * 5/1966 Rogers ..... H01J 35/26 378/41
6,292,538 B1 9/2001 Hell et al.
(Continued)

*Primary Examiner* — Irakli Kiknadze
(74) *Attorney, Agent, or Firm* — Alphapatent Associates, Ltd; Daniel J. Swirsky

(57) ABSTRACT

The X-ray tube disclosed herein includes an electron emission part including an electron emission element using a cold cathode; an anode part having an anode surface with which an electron emitted from the electron emission part collides; and a focusing structure disposed between the electron emission part and a target part disposed on the anode surface. The focusing structure has a plurality of focal point areas that are applied with a voltage in a mutually independent manner. The electron emission part has first and second electron beam emission areas that are on/off controlled in a mutually independent manner. The X-ray tube is designed in such a way that a collision area of the electron beam emitted from each of the first and second electron beam emission areas on the anode surface moves in response to a voltage applied to the focusing structure.

5 Claims, 8 Drawing Sheets

(51) Int. Cl.
*H05G 1/32* (2006.01)
*H01J 35/04* (2006.01)
*H05G 1/46* (2006.01)
*H01J 35/30* (2006.01)

(52) U.S. Cl.
CPC ..... *H05G 1/46* (2013.01); *H05G 1/52* (2013.01); *H01J 2235/062* (2013.01)

(58) Field of Classification Search
CPC .... H01J 2235/06; H01J 35/147; H01J 35/066; H01J 35/153; H01J 35/16; H01J 35/26; H01J 2203/022; H01J 2203/0224; H01J 2203/0236; H01J 2235/086; H01J 35/06; H01J 35/116; H01J 35/24; H01J 35/064; H01J 35/025; H01J 35/20; H01J 35/045; H01J 35/112; H01J 9/39; H01J 1/16; H05G 1/32; H05G 1/46; H05G 1/52; H05G 1/58; H05G 1/56; H05G 1/60; H05G 1/26; H05G 1/70; H05G 1/34; H05G 1/08; H05G 1/10; A61B 6/4021; A61B 6/405; A61B 6/482; A61B 5/055; A61B 6/022; A61B 6/027; A61B 6/032; A61B 6/4028; A61B 6/4085; A61B 6/025; A61B 6/4007; A61B 6/54; A61B 6/508; G01V 5/0025; G01N 2223/639; G01N 23/20008; G01N 2223/419; G01N 2223/612; G01N 23/046; G01N 23/225; G01N 23/2251; G01N 2021/653; G01N 2021/656; G01N 21/65; G01N 21/658; G01N 2201/0612; G01N 23/227; G01N 23/02; G01N 23/203; G21K 1/02; G21K 5/04; G21K 7/00; H05H 13/10; H05H 2007/227; H05H 7/06; H05H 7/18; H05H 7/22; H05H 9/00; H05H 11/00; H05H 5/00; B82Y 10/00; G01T 1/2985
USPC ..... 378/113, 114, 119, 122, 136, 137
See application file for complete search history.

(56) References Cited

U.S. PATENT DOCUMENTS

| | | | | |
|---|---|---|---|---|
| 7,257,194 | B2 | 8/2007 | Smith | |
| 7,483,518 | B2 * | 1/2009 | Hamill | G21K 1/10 378/144 |
| 7,839,979 | B2 * | 11/2010 | Hauttmann | H01J 35/147 378/137 |
| 8,588,372 | B2 | 11/2013 | Zou et al. | |
| 8,712,015 | B2 * | 4/2014 | Caiafa | H01J 35/153 378/110 |
| 2007/0133747 | A1 * | 6/2007 | Manak | A61B 6/5282 378/62 |
| 2008/0056436 | A1 * | 3/2008 | Pack | A61B 6/027 378/10 |
| 2009/0185661 | A1 * | 7/2009 | Zou | H01J 3/021 378/134 |
| 2012/0128122 | A1 | 5/2012 | Kautz et al. | |

* cited by examiner

X-RAY TUBE AND A CONTROLLER THEREOF

BACKGROUND OF THE INVENTION

Field of the Invention

The present invention relates to an X-ray tube and a controller thereof.

Description of Related Art

Conventional X-ray tubes generally use a filament as a cathode and, in this case, use thermoelectrons extracted from the filament as an electron source. An electron beam emitted from the electron source passes through a target disposed on the surface (hereinafter, referred to as "anode surface") of an anode that faces the cathode and then passes through the anode to be absorbed by a power supply. Hereinafter, an area in the anode surface with which the electron beam collides is referred to as "focal point area".

There is known a technology that moves the focal point area on the anode surface by controlling the trajectory of an electron beam emitted from an electron source. Examples of such a technology are disclosed in, for example, U.S. Pat. Nos. 6,292,538, 7,257,194, 8,588,372, and U.S. Patent Application Publication No. 2012/0128122. Being capable of moving the focal point area on the anode surface means being capable of moving a heating point on the anode surface, which, for example, can raise the upper limit of power supply to a fixed anode type X-ray tube. Further, in an X-ray tube for X-ray CT, photographing resolution can be increased by moving the focal point area (Flying Focus) (see Proceedings of SPIE, Volume 7622 (1), Apr. 1, 2010, A super resolution technique for clinical multi slice CT (Xin Liu, et al.)).

SUMMARY

However, conventional focal point area moving technology involves on/off control of thermoelectrons at high voltages and beam control using an electromagnetic field, thus disadvantageously complicating the structure of an X-ray tube.

The object of the present invention is to provide a cathode structure and a focusing structure of a cold cathode X-ray tube for avoiding the above problem and a drive method therefor and to achieve focal point area movement in the X-ray tube with a simple structure.

An X-ray tube according to the present invention includes: an electron emission part including an electron emission element using a cold cathode; an anode part having an anode surface with which an electron emitted from the electron emission part collides; and a focusing structure disposed between the electron emission part and a target part disposed on the anode surface. The focusing structure has a plurality of focal point areas that are applied with a voltage in a mutually independent manner. The electron emission part has first and second electron beam emission areas that are on/off controlled in a mutually independent manner. The X-ray tube is designed in such a way that a collision area of the electron beam emitted from each of the first and second electron beam emission areas on the anode surface moves in response to a voltage applied to the focusing structure.

An X-ray tube controller according to a first aspect of the present invention is a controller for an X-ray tube, wherein the X-ray tube including an electron emission part including an electron emission element using a cold cathode; an anode part having an anode surface with which an electron emitted from the electron emission part collides; and a focusing structure disposed between the electron emission part and a target part disposed on the anode surface, the focusing structure having a plurality of focusing areas that are applied with a voltage in a mutually independent manner, the electron emission part having first and second electron beam emission areas that are on/off controlled in a mutually independent manner, and the X-ray tube being designed in such a way that a collision area of the electron beam emitted from each of the first and second electron beam emission areas on the anode surface moves in response to a voltage applied to each of the plurality of focusing areas. The controller alternately turns on/off the first and second electron beam emission areas in sync with the voltage applied to each of the plurality of focusing areas.

An X-ray tube controller according to a second aspect of the present invention is a controller for an X-ray tube, wherein the X-ray tube including an electron emission part including an electron emission element using a cold cathode; an anode part having an anode surface with which an electron emitted from the electron emission part collides; and a focusing structure disposed between the electron emission part and a target part disposed on the anode surface, the focusing structure having two focusing areas that are applied with a voltage in a mutually independent manner, the electron emission part having first and second electron beam emission areas that are on/off controlled in a mutually independent manner, and the X-ray tube being designed in such a way that a collision area of the electron beam emitted from each of the first and second electron beam emission areas on the anode surface is moves in response to a voltage applied to each of the two focusing areas. The controller alternately applies a voltage to the two focusing areas during driving of the electron emission part to move the collision area.

An X-ray tube controller according to a third aspect of the present invention is a controller for an X-ray tube, the X-ray tube including an electron emission part including an electron emission element using a cold cathode; an anode part having an anode surface with which an electron emitted from the electron emission part collides; and a focusing structure disposed between the electron emission part and a target part disposed on the anode surface, the focusing structure having a plurality of focusing areas that are applied with a voltage in a mutually independent manner, the electron emission part having first and second electron beam emission areas that are on/off controlled in a mutually independent manner, and the X-ray tube being designed in such a way that a collision area of the electron beam emitted from each of the first and second electron beam emission areas on the anode surface is moves in response to a voltage applied to each of the plurality of focusing areas. The controller changes stepwise a voltage to be applied to the each of the plurality of focusing areas during driving of the electron emission part to dynamically move the collision area.

An X-ray tube controller according to a fourth aspect of the present invention is a controller for an X-ray tube, the X-ray tube including a plurality of electron emission parts each including an electron emission element using a cold cathode; an anode part having an anode surface with which an electron emitted from each of the plurality of electron emission parts collides; and a plurality of focusing structures each disposed between each of the plurality of electron emission parts and a target part disposed on the anode surface, the plurality of focusing structures each having a plurality of focusing areas that are applied with a voltage in a mutually independent manner, the plurality of electron emission parts each having first and second electron beam emission areas that are on/off controlled in a mutually independent manner, and the X-ray tube being designed in such a way that a collision area of the electron beam emitted from each of the first and second electron beam emission areas belonging to each of the plurality of electronic emission parts on the anode surface moves in response to a voltage applied to each of the plurality of corresponding focusing areas. The controller sequentially controls the plurality of electron beam emission parts to sequentially emit an X-ray from a plurality of different areas on the anode surface.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

The present invention moves the focal point area on the anode surface of a cold cathode electronic tube with a simple method. Specifically, the present invention has a plurality of electron beam emission parts that can be controlled independently of one another and a plurality of focusing areas surrounding the electronic emission areas, and changes the position of the focal point area on the anode surface by electrostatically changing a voltage to be applied to each focusing area.

Using the cold cathode and electrostatic focusing structure allows a comparatively large movement of the focal point area with a simple structure. The cold cathode has a higher degree of freedom in design than a filament, so that focus control is facilitated only with the electrostatic focusing structure. The present invention utilizes this advantage.

Hereinafter, first to fourth embodiments of the present invention will be described sequentially.

First Embodiment

Figure 1A:
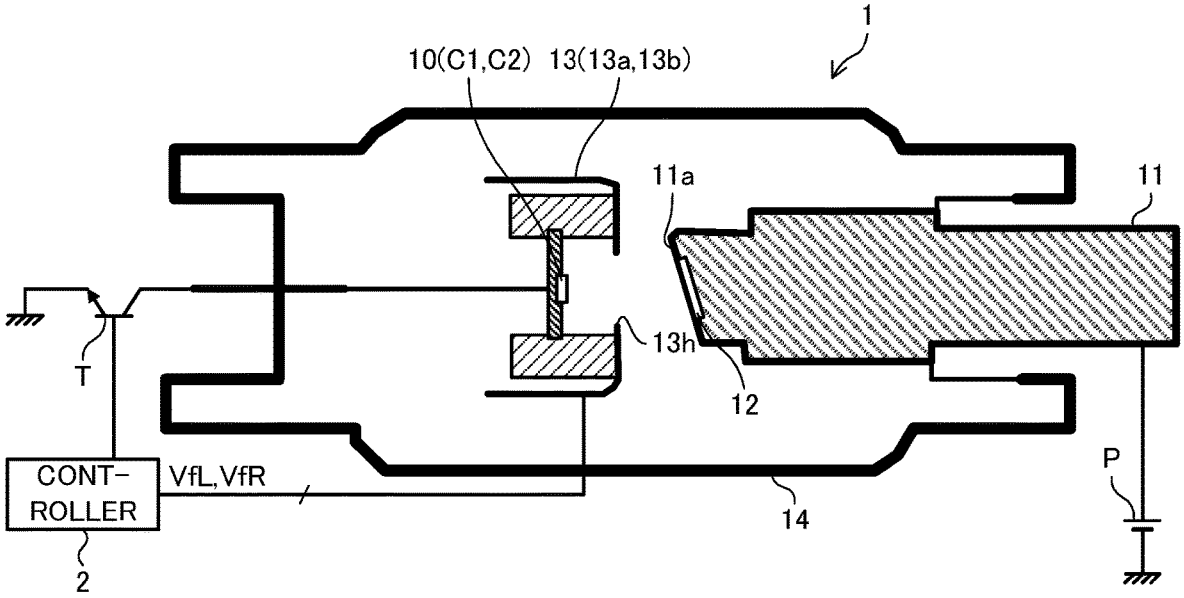
FIG. 1A is a schematic cross-sectional view of an X-ray tube 1 according to the first embodiment of the present invention.

FIG. 1A is a schematic cross-sectional view of an X-ray tube 1 according to the first embodiment of the present invention. As illustrated in FIG. 1A, the X-ray tube 1 has a structure in which an electron emission part 10, an anode part 11, a target part 12, and a focusing structure 13 are disposed in a vacuum area surrounded by a glass outer wall 14. FIG. 1A also illustrates a controller 2 for the X-ray tube 1.

Figure 1B:
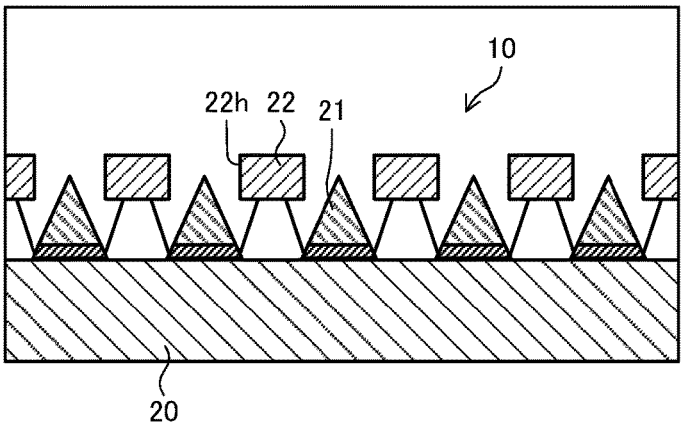
FIG. 1B is a schematic cross-sectional view of the electron emission part 10 shown in FIG. 1A.

FIG. 1B is a schematic cross-sectional view of the electron emission part 10. As illustrated in FIG. 1B, the electron emission part 10 includes a cathode part 20, a plurality of electron emission elements 21 disposed on the upper surface of the cathode part 20, and a gate electrode 22 having a plurality of openings 22*h* which are arranged in a matrix. The plurality of electron emission elements 21 are each a Spindt-type cold cathode element and disposed in the openings 22*h* one by one. The upper end of each electron emission element 21 is positioned in the openings 22*h*. The cathode part 20 is connected to the ground end through a transistor T and is grounded when the transistor T is ON.

The anode part 11 has an anode surface 11*a* with which an electron emitted from the electron emission part 10 collides. The anode surface 11*a* is the surface of the anode part 11 that faces the electron emission part 10. The anode part 11 is connected with a power supply P, so that when the transistor T is ON, current flows from the power supply P to the anode part 11, electron emission part 10, and cathode part 20, sequentially. At this time, a plurality of electrons are emitted from each of the electron emission elements 21 illustrated in FIG. 1B. The anode surface 11*a* constitutes a collision surface of these electrons and the electrons colliding with the anode surface 11*a* pass through the inside of the anode part 11 and are then absorbed by the power supply P. As illustrated in FIG. 1A, the anode surface 11*a* is formed so as to be inclined with respect to the moving direction of the electrons (in FIG. 1A, the direction from left to right).

The target part 12 is a member made of a material that generates an X-ray by receiving electrons and disposed on the anode surface 11*a*. Since the target part 12 is disposed on the anode surface 11*a*, some or all of the plurality of electrons that collide with the anode surface 11*a* pass through the target part 12, and an X-ray is generated in the target part 12 during the passage. The thus generated X-ray is radiated downward in FIG. 1A due to inclination of the anode surface 11*a*.

The focusing structure 13 is a structure having a function of correcting the trajectory of the electron emitted from the electron emission part 10 and is disposed between the electron emission part 10 and the target part 12 disposed on the anode surface 11*a*. The focusing structure 13 has a window 13*h*. The electrons emitted from the electron emission part 10 are directed to the target part 12 through the window 13*h*.

Figure 2:
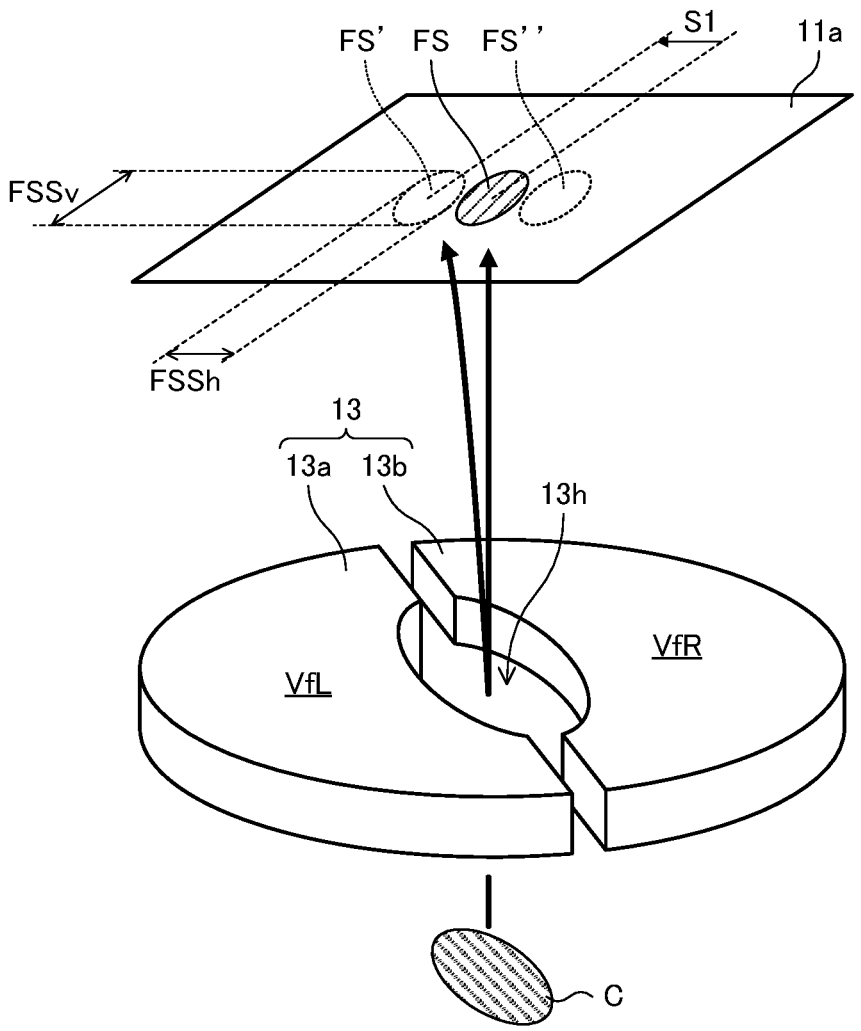
FIG. 2 is a view schematically illustrating the configuration of a part of the X-ray tube 1 shown in FIG. 1A between the electron emission part 10 and the anode surface 11*a;*

FIG. 2 is a view schematically illustrating the configuration of a part of the X-ray tube 1 between the electron emission part 10 and the anode surface 11*a*. As illustrated in FIG. 2, the focusing structure 13 according to the present embodiment has a disk-like outer shape having an ellipsoidal window 13*h* at the center thereof. Further, the focusing structure 13 is divided into two focusing areas 13*a* and 13*b* by a line forming the diameter of the outer shape. The focusing areas 13*a* and 13*b* are electrically independent of each other and can be applied with mutually different voltages VfL and VfR, respectively.

Referring back to FIG. 1A, the controller 2 controls a connection state between the cathode part 20 and the ground end by performing on/off control of the transistor T and applies the mutually different voltages VfL and VfR to the focusing areas 13*a* and 13*b*.

Referring again to FIG. 2, an area C illustrated in FIG. 2 is an emission area of an electron beam emitted from the electron emission part 10. When the controller 2 turns ON the transistor T to connect the cathode part 20 to the ground end, an electron beam is emitted from the electron beam emission area C toward the anode surface 11*a*. A focal point area FS which is a collision area of the electron beam on the anode surface 11*a* moves within the anode surface 11*a* in response to a change in the values of voltages VfL and VfR applied to the focusing areas 13*a* and 13*b*. A focal point area FS' and a focal point area FS" denoted by dashed lines in FIG. 2 each illustrate an example of the position of the focal point area FS after thusly moving. The reason why the focal point area FS moves in this manner is that a magnetic field generated from the focusing areas 13*a* and 13*b* is changed in response to the change in the voltages VfL and VfR to correct the trajectory of the electron beam. Thus, the controller 2 according to the present embodiment is configured to move the focal point area FS intentionally by changing the values of the voltages VfL and VfR by design. Although not illustrated in FIG. 2, the change in the values of the voltages VfL and VfR under the control of the controller 2 can also change the shape of the focal point area FS.

Figure 3:
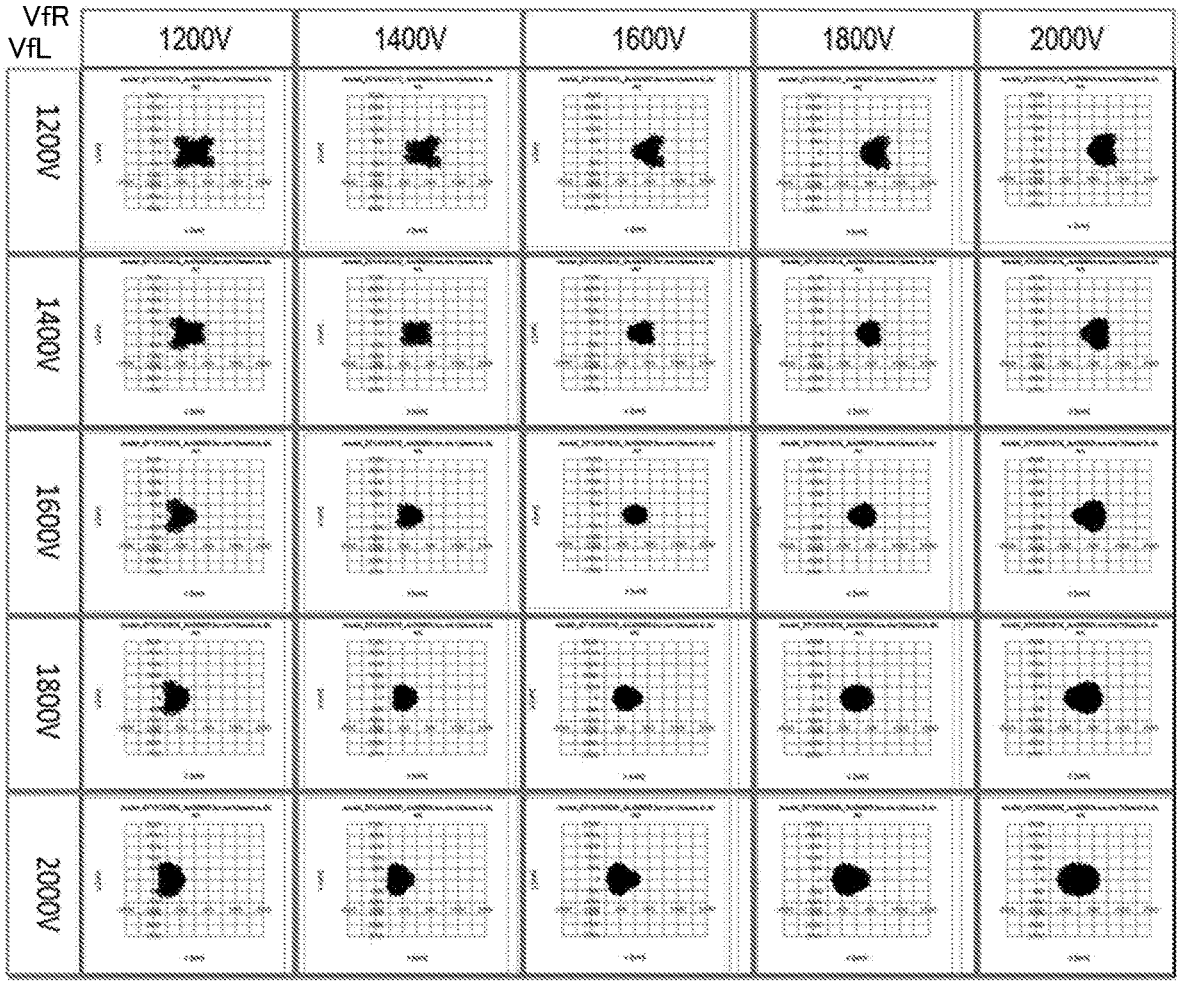
FIG. 3 is a view illustrating changes in the position and shape of the focal point area FS when the voltages VfL and VfR shown in FIG. 2 are changed.

FIG. 3 is a view illustrating changes in the position and shape of the focal point area FS when the voltages VfL and VfR are changed. More specifically, FIG. 3 illustrates simulation results of the focal point area FS when the voltages VfL and VfR are each changed stepwise from 1200 V to 2000 V by 200 V in a state where the power supply P of 50 KV is used, 0 V is applied to the cathode part 20, and 35 V is applied to the gate electrode 22. In FIG. 3 a black area in each section view represents the focal point area FS. It can be understood from the results of FIG. 3 that the position and shape of the focal point area FS can be changed by changing the voltages VfL and VfR.

Figure 4:
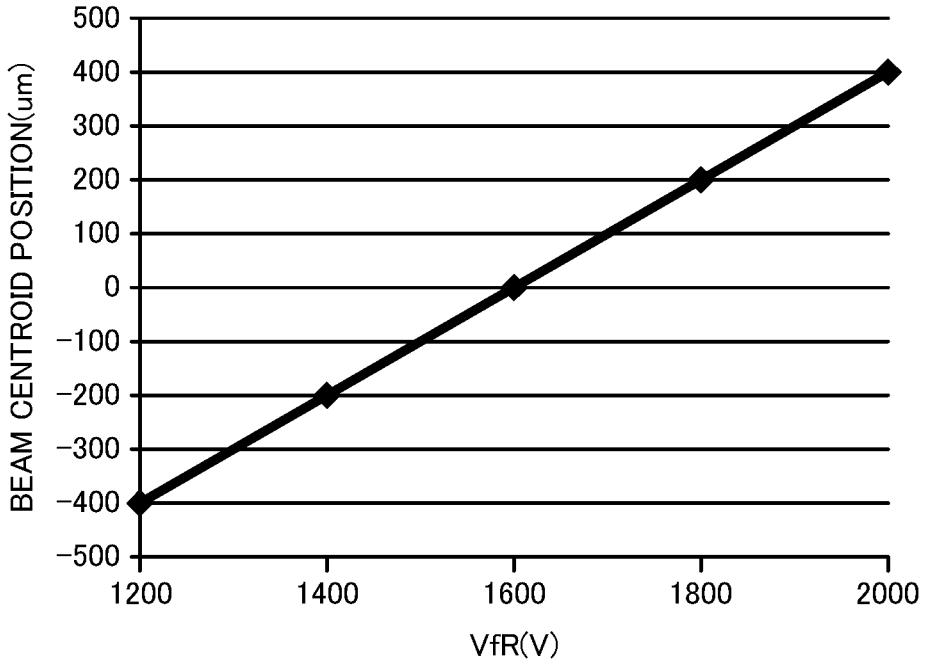
FIG. 4 is a view illustrating the relationship between the voltage VfR shown in FIG. 2 and the beam centroid position.

FIG. 4 is a view illustrating the relationship between the voltage VfR and the beam centroid position (position at which the density of the electron beam takes the highest value). More specifically, FIG. 4 illustrates simulation results of the beam centroid position when the potential VfL is fixed to 1600 V while the voltage VfR is changed stepwise from 1200 V to 2000 V by 200 V. It can be understood from the results of FIG. 4 that the beam centroid position can be moved by 0.8 mm from the −0.4 mm position to +0.4 mm position by changing the value of the voltage VfR.

As described above, according to the present embodiment, it becomes possible to move the focal point area FS by changing the voltages VfL and VfR under control of the controller 2. Thus, it can be said that it becomes possible to achieve the movement of the focal point area FS on the anode surface 11*a* of the X-ray tube 1 with a comparatively simple structure by using the electron emission elements 21 which are cold cathode elements. Also, as a result of that, it becomes possible to easily realize X-ray imaging utilizing the plurality of focal point areas FS, X-ray imaging requiring dynamic movement of the focal point area FS, and tomosynthesis imaging.

Second Embodiment

Figure 5:
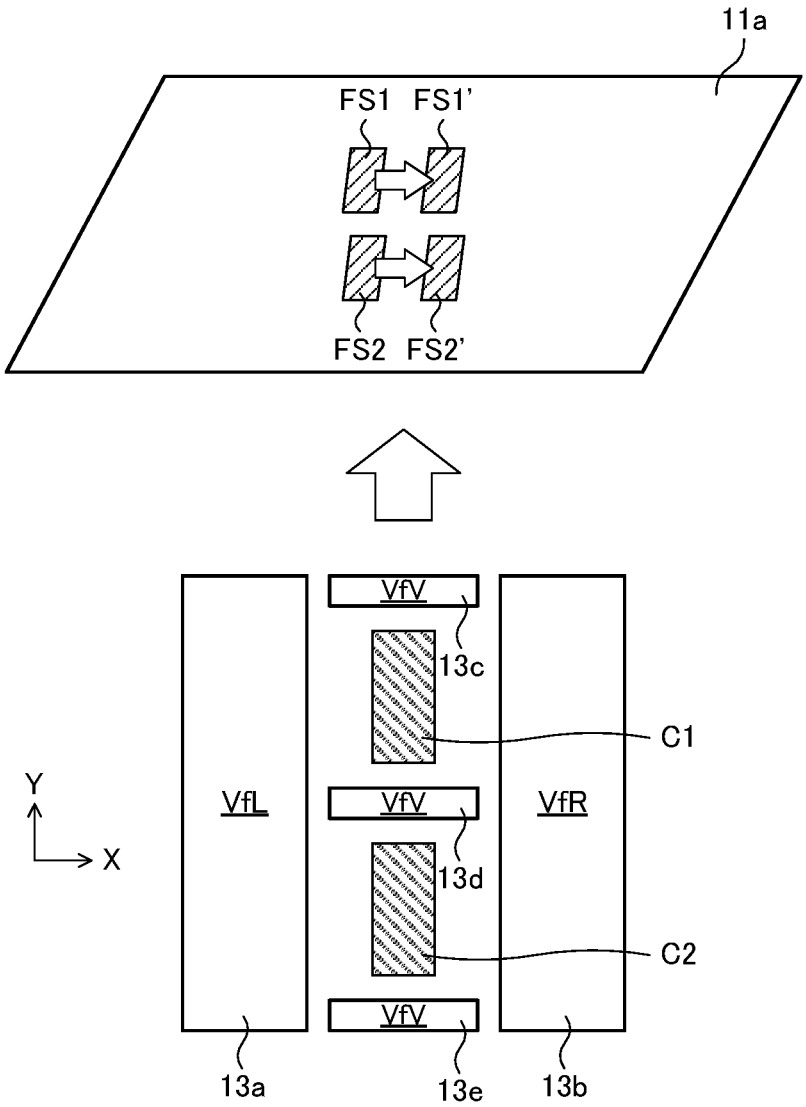
FIG. 5 is a view schematically illustrating the configuration of a part of the X-ray tube 1 according to the second embodiment of the present invention between the electron emission part 10 and the anode surface 11*a;*

FIG. 5 is a view illustrating the configuration of the X-ray tube 1 according to the second embodiment of the present invention. The X-ray tube 1 according to the present embodiment differs from the X-ray tube 1 according to the first embodiment in that the electron beam emission area C illustrated in FIG. 2 is divided into a plurality of areas. Further, the concrete configuration of the focusing structure 13 also differs from that of the X-ray tube 1 according to the first embodiment. Other configurations are the same as those of the X-ray tube 1 according to the first embodiment, so the same reference numerals are given to the same elements, and the different points from the first embodiment will mainly be described.

The electron emission part 10 according to the present embodiment includes first and second electron beam emission areas C1 and C2. The first and second electron beam emission areas C1 and C2 are each an emission area of an electron beam emitted from the electron emission part 10 and can be on/off controlled independently of each other under the control of the controller 2. This configuration is achieved by providing, in place of the transistor T of FIG. 1, a first transistor (not illustrated) connected between the cathode part 20 of the first electron beam emission area C1 and the ground end and a second transistor (not illustrated) connected between the cathode part 20 of the second electron beam emission area C2 and the ground end and by performing on/off control of the first and second transistors independently under the control of the controller 2.

As illustrated in FIG. 5, the first and second electron beam emission areas C1 and C2 are each a rectangular area elongated in the illustrated Y-direction and are arranged in the Y-direction.

The focusing structure 13 according to the present embodiment is divided into five focusing areas 13*a* to 13*e* that can be applied with voltage in a mutually independent manner. The controller 2 applies a voltage VfL to the focusing area 13*a*, a voltage VfR to the focusing area 13*b*, and a voltage VfV to the focusing areas 13*c* to 13*e*.

The focusing areas 13*c* to 13*e* are each a rectangular area elongated in the illustrated X-direction (the direction perpendicular to the Y-direction) and are arranged in this order in the Y-direction at an equal interval. The first electron beam emission area C1 is disposed between the focusing areas 13*c* and 13*d*, and the second electron beam emission area C2 is disposed between the focusing areas 13*d* and 13*e*. The focusing areas 13*a* and 13*b* are each a rectangular area elongated in the illustrated Y-direction and are arranged in the X-direction. The focusing areas 13*c* to 13*e* and first and second electron beam emission areas C1 and C2 are disposed between the focusing areas 13*a* and 13*b*.

When the controller 2 changes the voltage VfR from 1200 V to 2000 V in a state where the first electron beam emission area C1 is ON and where both the voltages VfV and VfL are fixed to 1600 V, the focal point area of the electron beam emitted from the first electron beam emission area C1 moves from a focal point area FS1 to a focal point area FS1' as illustrated in FIG. 5. Similarly, when the controller 2 changes the voltage VfR from 1200 V to 2000 V in a state where the second electron beam emission area C2 is ON and where both the voltages VfV and VfL are fixed to 1600 V, the focal point area of the electron beam emitted from the second electron beam emission area C2 moves from a focal point area FS2 to a focal point area FS2' as illustrated in FIG. 5.

As described above, according to the present embodiment, if becomes possible to move each of the focal point area of the electron beam emitted from the first electron beam emission area C1 and the focal point area of the electron beam emitted from the second electron beam emission area C2 largely as illustrated in FIG. 5.

Third Embodiment

Figure 6A:
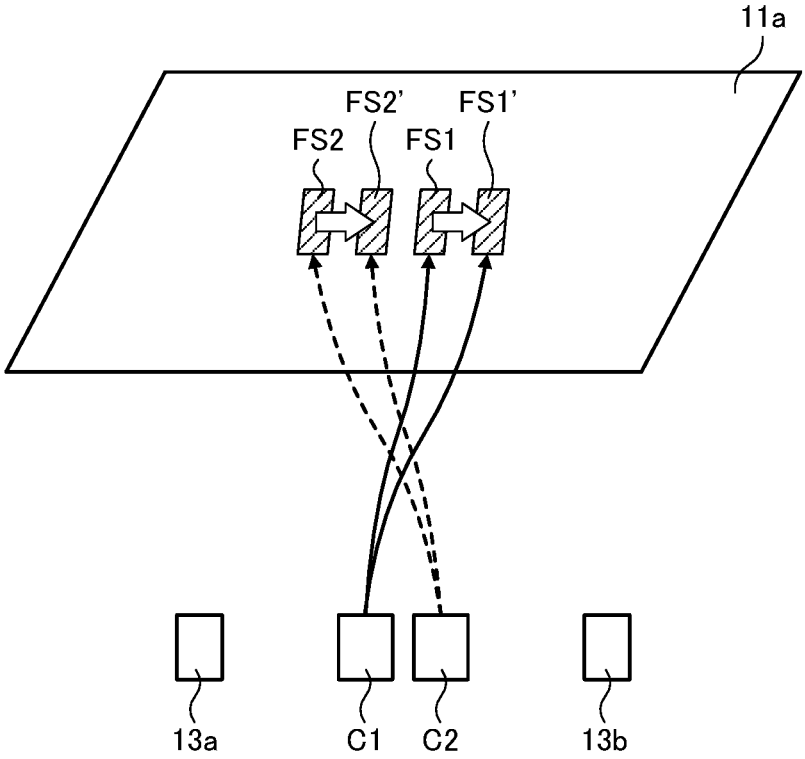
FIG. 6A is a view schematically illustrating the configuration of a part of the X-ray tube 1 according to the third embodiment of the present invention between the electron emission part 10 and the anode surface 11*a;*
Figure 6B:
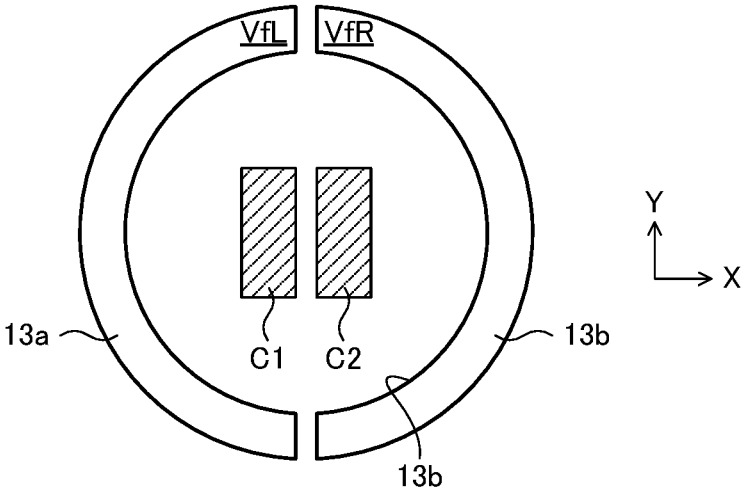
FIG. 6B a schematic plan view of the electron emission part 10 and focusing structure 13 of the X-ray tube 1 according the third embodiment of the present invention.

FIG. 6A is a view schematically illustrating the configuration of a part of the X-ray tube 1 according to the third embodiment of the present invention between the electron emission part 10 and the anode surface 11*a*. FIG. 6B is a schematic plan view of the electron emission part 10 and focusing structure 13 of the X-ray tube 1 according to the present embodiment. The X-ray tube 1 according to the present embodiment differs from the X-ray tube 1 according to the second embodiment in planar arrangement of the first and second electron beam emission areas C1 and C2 and the concrete configuration of the focusing structure 13. Further, control contents performed by the controller 2 also differ from those of the X-ray tube 1 according to the second embodiment. Other configurations are the same as those of the X-ray tube 1 according to the second embodiment, so the same reference numerals are given to the same elements, and the different points from the second embodiment will mainly be described.

The first and second electron beam emission areas C1 and C2 according to the present embodiment are each a rectangular area elongated in the illustrated Y-direction and are arranged in the X-direction perpendicular to the Y-direction.

The focusing structure 13 according to the present embodiment has a disk-like outer shape having a circular window 13*h* at the center thereof and is divided into two focusing areas 13*a* and 13*b* by a line forming the diameter of the outer shape. The first and second electron beam emission areas C1 and C2 are disposed at the center of the window 13*h* in a plan view. The electrical configuration of the focusing areas 13*a* and 13*b* is the same as that in the first embodiment, and the controller 2 applies the voltages VfL and VfR to the focusing areas 13*a* and 13*b*, respectively.

The controller 2 according to the present embodiment alternately turns on/off the first and second electron beam emission areas C1 and C2 in sync with the voltage applied to each of the focusing areas 13*a* and 13*b*. In another viewpoint, the controller 2 alternately applies a voltage to the two focusing areas 13*a* and 13*b* during driving of the electron emission part 10. According to the control performed by the controller 2, the movable range of the focusing area becomes wider than those in the first and second embodiments. Hereinafter, details will be described with reference to FIG. 6A and FIG. 7.

Figure 7:
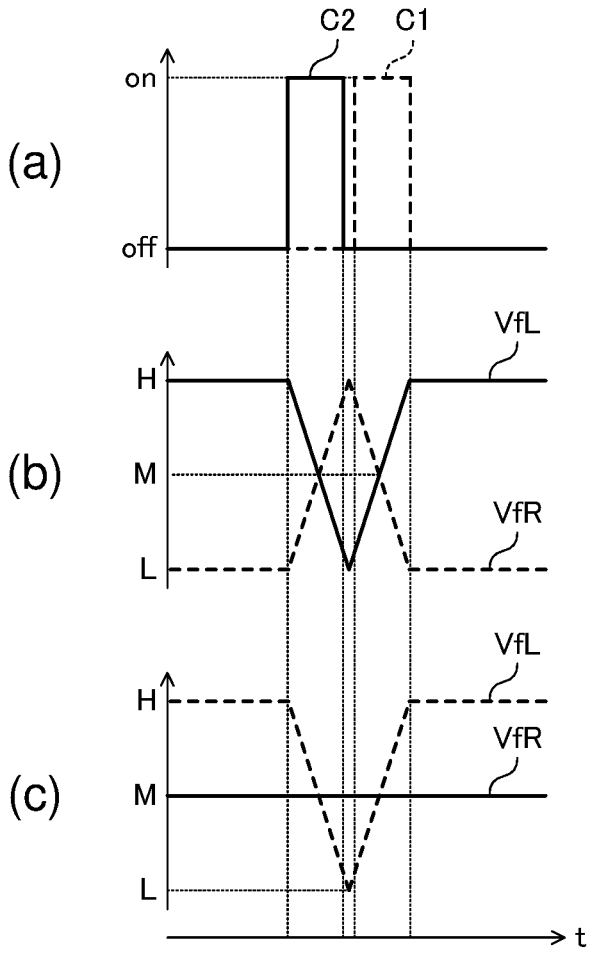
FIG. 7 is a view illustrating the temporal relationship between the on/off states of the respective first and second electron beam emission areas C1 and C2 shown in FIG. 6B and the voltages VfL and VfR shown in FIG. 6B.

FIG. 7 are views illustrating the temporal relationship between the on/off states of the respective first and second electron beam emission areas C1 and C2 and the voltages VfL and VfR according to the present embodiment. FIG. 7(*a*) illustrates the on/off states of the respective first and second electron beam emission areas C1 and C2, FIG. 7(*b*) illustrates an example of changes in the respective voltages VfL and VfR, and FIG. 7(*c*) illustrates another example of changes in the respective voltages VfL and VfR.

As illustrated in FIGS. 7(*a*) and 7(*b*), the controller 2 according to the present embodiment changes the voltage VfL and voltage VfR from High to Low and Low to High, respectively, while the second electron beam emission area C2 is ON. As a result, the focal point area of the electron beam emitted from the second electron beam emission area C2 moves from the focal point area FS2 to the focal point area FS2' as illustrated in FIG. 6A. Then, the controller 2 turns OFF the second electron beam emission area C2, turns ON the first electron beam emission area C1, and changes the voltage VfL and voltage VfR from Low to High and High to Low, respectively. As a result, the focal point area of the electron beam emitted from the first electron beam emission area C1 moves from the focal point area FS1 to the focal point area FS1' as illustrated in FIG. 6A.

As described above, according to the present embodiment, it becomes possible to move the focal point area largely from the area FS2 shown in FIG. 6A to the area FS1' shown in FIG. 6A in a continuous manner. Therefore, it can be said that the movable range of the focal point area becomes wider than those in the first and second embodiments.

As illustrated in FIG. 7C, only one of the voltages VfL and VfR may be changed with the other one thereof set to a fixed potential. In this case, the fixed potential is preferably set to an intermediate potential between High and Low. Even in this case, the relative magnitude correlation between the voltages VfL and VfR are the same as that in the example of FIG. 7B, so that the movable range of the focal point area can be widened as in the example of FIG. 7B.

Fourth Embodiment

Figure 8:
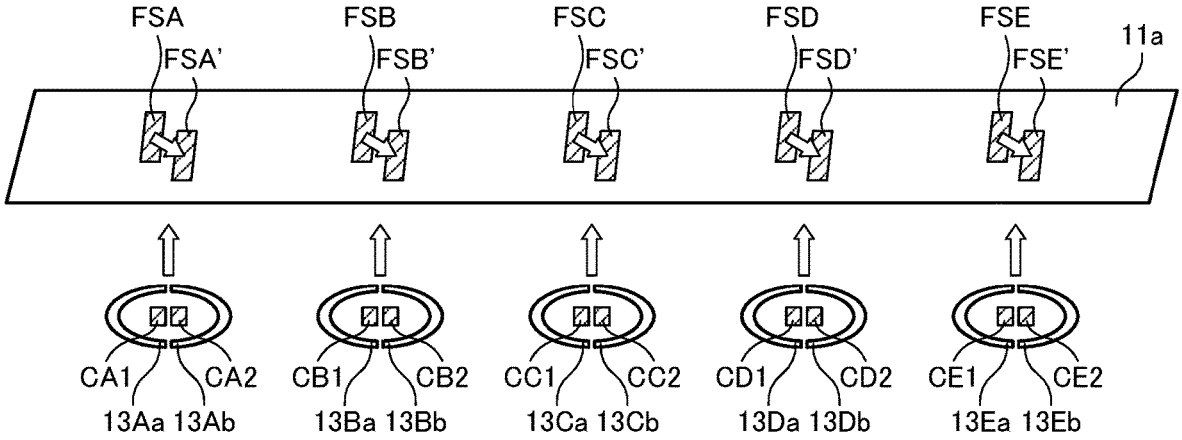
FIG. 8 is a view schematically illustrating the configuration of the X-ray tube 1 according to the fourth embodiment of the present invention.

FIG. 8 is a view schematically illustrating the configuration of the X-ray tube 1 according to the fourth embodiment of the present invention. The X-ray tube 1 according to the present embodiment differs from the X-ray tube 1 according to the third embodiment in that it is a multi-source X-ray tube 1 having a plurality of electron emission parts 10. Further, control contents performed by the controller 2 also differs from those of the X-ray tube 1 according to the third embodiment. Other configurations are the same as those of the X-ray tube 1 according to the third embodiment, so the same reference numerals are given to the same elements, and the different points from the third embodiment will mainly be described.

The X-ray tube 1 according to the present embodiment includes five electron emission parts 10. The individual electron emission part 10 has the same configuration as that in the third embodiment and includes two electron beam emission areas C1 and C2. In FIG. 8, the electron beam emission areas C1 and C2 of the first electron emission part 10 are referred to respectively as electron beam emission areas CA1 and CA2, the electron beam emission areas C1 and C2 of the second electron emission part 10 are referred to respectively as electron beam emission areas CB1 and CB2, the electron beam emission areas C1 and C2 of the third electron emission part 10 are referred to respectively as electron beam emission areas CC1 and CC2, the electron beam emission areas C1 and C2 of the fourth electron emission part 10 are referred to respectively as electron beam emission areas CD1 and CD2, and the electron beam emission areas C1 and C2 of the fifth electron emission part 10 are referred to respectively as electron beam emission areas CE1 and CE2.

Five focusing structures 13 are prepared corresponding to the five electron emission part 10. The individual focusing structure 13 has the same configuration as that in the third embodiment and includes two focusing areas 13*a* and 13*b* which are arranged so as to surround their corresponding electron beam emission areas C1 and C2, respectively, in a plan view. In FIG. 8, the focusing areas 13*a* and 13*b* corresponding respectively to the electron beam emission areas CA1 and CA2 are referred to respectively as focusing areas 13Aa and 13Ab, the focusing areas 13*a* and 13*b* corresponding respectively to the electron beam emission areas CB1 and CB2 are referred to respectively as focusing areas 13Ba and 13Bb, the focusing areas 13*a* and 13*b* corresponding respectively to the electron beam emission areas CC1 and CC2 are referred to respectively as focusing areas 13Ca and 13Cb, the focusing areas 13*a* and 13*b* corresponding respectively to the electron beam emission areas CD1 and CD2 are referred to respectively as focusing areas 13Da and 13Db, and the focusing areas 13*a* and 13*b* corresponding respectively to the electron beam emission areas CE1 and CE2 are referred to respectively as focusing areas 13Ea and 13Eb.

The controller 2 according to the present embodiment performs the same control for the individual electron emission part 10 and individual focusing structure 13 as that in the third embodiment. The focal point areas FSA and FSA' illustrated in FIG. 8 correspond respectively to the focal point areas FS2 and FS1' illustrated in FIG. 6A in the correspondence relation to the electron beam emission areas CA1 and CA2 and focusing areas 13Aa and 13Ab. The same can be said for the focal point areas FSB and FSB', focal point areas FSC and FSC', focal point areas FSD and FSD', and focal point areas FSE and FSE'.

Further, the controller 2 according to the present embodiment controls the five electron emission parts 10 and their corresponding focusing structures 13 in a time series manner. As a result, an X-ray is emitted from different areas (sequentially from the focal point areas FSA, FSA', FSB, FSB', FSC, FSC', FSD, FSD', FSE, and FSE') on the anode surface 11*a*.

As described above, according to the present embodiment, it becomes possible to emit an X-ray sequentially from different areas on the anode surface 11*a*. Thus, it becomes possible to obtain many pieces of image information without increasing the number of the electron emission parts 10 and complicating the structure of the X-ray tube, and this makes it possible to obtain a high definition tomosynthesis image.

While the preferred embodiments of the present invention have been described, the present invention is not limited to the above embodiments but may be variously modified within the scope thereof.

For example, the controller 2 according to the respective embodiments may change stepwise a voltage to be applied to the plurality of focusing areas during driving of the electronic emission part 10 to dynamically move the focal point area. With this configuration, it becomes possible to move the focal point area in stages.

What is claimed is:

1. An X-ray tube comprising:

an electron emission part including a cold cathode comprising a plurality of electron emission elements disposed upon an upper surface of a cathode part, and a gate electrode having a plurality of openings arranged in a matrix, said cathode part comprising:

a first electron beam emission area connected to a ground end through a first transistor such that the first electron beam emission area is grounded when the first transistor is ON, and a second electron beam emission area connected to the ground end through a second transistor such that the second electron beam emission area is grounded when the second transistor is ON;

a controller configured to control:

a first connection state between the first electron beam emission area and the ground end by performing ON/OFF control of the first transistor such that a first electron beam is emitted from the first electron beam emission area, and a second connection state between the second electron beam emission area and the ground end by performing ON/OFF control of the second transistor such that a second electron beam is emitted from the second electron beam emission area;

an anode part having an anode surface with which an electron emitted from the electron emission part collides; and a focusing structure disposed between the electron emission part and a target part disposed on the anode surface, wherein the focusing structure has a plurality of focal point areas that are applied with a voltage in a mutually independent manner, the X-ray tube is designed in such a way that a collision area of the electron beam emitted from each of the first and second electron beam emission areas on the anode surface moves in response to a voltage applied to the focusing structure, and the controller alternately activates the first transistor and the second transistor in sync with the voltage applied to each of the plurality of focusing areas such that:

only the first electron beam is emitted from the first electron beam emission area when no second electron beam is emitted from the second electron beam emission area, and only the second electron beam is emitted from the second electron beam emission area when no first electron beam is emitted from the first electron beam emission area.

2. A controller for an X-ray tube, wherein the X-ray tube comprises:

an electron emission part including a cold cathode comprising a plurality of electron emission elements disposed upon an upper surface of a cathode part, and a gate electrode having a plurality of openings arranged in a matrix, said cathode part comprising:

a first electron beam emission area connected to a ground end through a first transistor such that the first electron beam emission area is grounded when the first transistor is ON, and a second electron beam emission area connected to the ground end through a second transistor such that the second electron beam emission area is grounded when the second transistor is ON;

an anode part having an anode surface with which an electron emitted from the electron emission part collides; and a focusing structure disposed between the electron emission part and a target part disposed on the anode surface, the focusing structure having a plurality of focusing areas that are applied with a voltage in a mutually independent manner, and the X-ray tube being designed in such a way that a collision area of the electron beam emitted from each of the first and second electron beam emission areas on the anode surface moves in response to a voltage applied to each of the plurality of focusing areas, wherein the controller is configured to control:

a first connection state between the first electron beam emission area and the ground end by performing ON/OFF control of the first transistor such that a first electron beam is emitted from the first electron beam emission area, a second connection state between the second electron beam emission area and the ground end by performing ON/OFF control of the second transistor such that a second electron beam is emitted from the second electron beam emission area, and the controller alternately activates the first transistor and the second transistor in sync with the voltage applied to each of the plurality of focusing areas such that:

only the first electron beam is emitted from the first electron beam emission area when no second electron beam is emitted from the second electron beam emission area, and only the second electron beam is emitted from the second electron beam emission area when no first electron beam is emitted from the first electron beam emission area.

3. A controller for an X-ray tube, wherein the X-ray tube comprises:

an electron emission part including a cold cathode comprising a plurality of electron emission elements disposed upon an upper surface of a cathode part, and a gate electrode having a plurality of openings arranged in a matrix, said cathode part comprising:

a first electron beam emission area connected to a ground end through a first transistor such that the first electron beam emission area is grounded when the first transistor is ON, and a second electron beam emission area connected to the ground end through a second transistor such that the second electron beam emission area is grounded when the second transistor is ON;

an anode part having an anode surface with which an electron emitted from the electron emission part collides; and a focusing structure disposed between the electron emission part and a target part disposed on the anode surface, the focusing structure having two focusing areas that are applied with a voltage in a mutually independent manner, and the X-ray tube being designed in such a way that a collision area of the electron beam emitted from each of the first and second electron beam emission areas on the anode surface moves in response to a voltage applied to each of the two focusing areas, wherein the controller alternately applies a voltage to the two focusing areas during driving of the electron emission part to move the collision area.

4. A controller for an X-ray tube, wherein the X-ray tube comprises:

an electron emission part including a cold cathode comprising a plurality of electron emission elements disposed upon an upper surface of a cathode part, and a gate electrode having a plurality of openings arranged in a matrix, said cathode part comprising:

a first electron beam emission area connected to a ground end through a first transistor such that the first electron beam emission area is grounded when the first transistor is ON, and a second electron beam emission area connected to the ground end through a second transistor such that the second electron beam emission area is grounded when the second transistor is ON;

an anode part having an anode surface with which an electron emitted from the electron emission part collides; and a focusing structure disposed between the electron emission part and a target part disposed on the anode surface, the focusing structure having a plurality of focusing areas that are applied with a voltage in a mutually independent manner, and the X-ray tube being designed in such a way that a collision area of the electron beam emitted from each of the first and second electron beam emission areas on the anode surface moves in response to a voltage applied to each of the plurality of focusing areas, wherein the controller changes stepwise a voltage to be applied to the each of the plurality of focusing areas during driving of the electron emission part to dynamically move the collision area.

5. A controller for an X-ray tube, wherein the X-ray tube comprises:

a plurality of electron emission parts each including a cold cathode comprising a plurality of electron emission elements disposed upon an upper surface of a cathode part, and a gate electrode having a plurality of openings arranged in a matrix, said cathode part comprising:

a first electron beam emission area connected to a ground end through a first transistor such that the first electron beam emission area is grounded when the first transistor is ON, and a second electron beam emission area connected to the ground end through a second transistor such that the second electron beam emission area is grounded when the second transistor is ON;

an anode part having an anode surface with which an electron emitted from each of the plurality of electron emission parts collides; and a plurality of focusing structures each disposed between each of the plurality of electron emission parts and a target part disposed on the anode surface, the plurality of focusing structures each having a plurality of focusing areas that are applied with a voltage in a mutually independent manner, and the X-ray tube being designed in such a way that a collision area of the electron beam emitted from each of the first and second electron beam emission areas belonging to each of the plurality of electronic emission parts on the anode surface moves in response to a voltage applied to each of the plurality of corresponding focusing areas, wherein the controller sequentially controls the plurality of electron beam emission parts to sequentially emit an X-ray from a plurality of different areas on the anode surface and controls the plurality of focusing structures in conjunction with the electron beam emission parts.

* * * * *